US011083244B2

(12) United States Patent
Boys et al.

(10) Patent No.: US 11,083,244 B2
(45) Date of Patent: Aug. 10, 2021

(54) SHOE HAVING DUAL MATERIAL SOLE

(71) Applicant: Cole Haan LLC, Greenland, NH (US)

(72) Inventors: Jack Boys, Greenland, NH (US); Aubert Shepherd, Greenland, NH (US); Raghu Yalamanchili, Greenland, NH (US)

(73) Assignee: COLE HAAN LLC, Greenland, NH (US)

( * ) Notice: Subject to any disclaimer, the term of this patent is extended or adjusted under 35 U.S.C. 154(b) by 0 days.

(21) Appl. No.: 16/514,228

(22) Filed: Jul. 17, 2019

(65) Prior Publication Data

US 2021/0015206 A1 Jan. 21, 2021

(51) Int. Cl.

| | |
|---|---|
| ***A43B 13/12*** | (2006.01) |
| ***A43B 13/14*** | (2006.01) |
| ***A43B 13/22*** | (2006.01) |

(52) U.S. Cl.

CPC ..... *A43B 13/125* (2013.01); *A43B 13/122* (2013.01); *A43B 13/141* (2013.01); *A43B 13/223* (2013.01)

(58) Field of Classification Search

CPC ... A43B 13/125; A43B 13/122; A43B 13/141; A43B 13/223; A43B 13/00; A43B 13/02; A43B 13/04; A43B 13/12; A43B 13/127; A43B 13/14; A43B 13/146; A43B 13/16; A43B 13/18; A43B 13/181; A43B 13/186; A43B 13/187; A43B 13/188; A43B 13/22

USPC ..... 36/103, 102, 25 R, 28, 30 R, 30 A, 31

See application file for complete search history.

(56) References Cited

U.S. PATENT DOCUMENTS

| | | | | |
|---|---|---|---|---|
| 5,185,943 | A | 2/1993 | Tong et al. | |
| 8,695,236 | B2 | 4/2014 | Nishiwaki et al. | |
| 9,999,276 | B2 * | 6/2018 | Adeagbo | A43B 23/0265 |
| 2007/0023955 | A1 * | 2/2007 | Ho | A43B 13/12 264/244 |
| 2013/0291409 | A1 | 11/2013 | Reinhardt et al. | |
| 2014/0250720 | A1 * | 9/2014 | Miner | A43B 13/20 36/29 |
| 2018/0092431 | A1 | 4/2018 | Iuchi et al. | |
| 2018/0295934 | A1 | 10/2018 | Bernhard et al. | |

* cited by examiner

*Primary Examiner* — Jameson D Collier
*Assistant Examiner* — F Griffin Hall
(74) *Attorney, Agent, or Firm* — Thompson Coburn LLP

(57) ABSTRACT

A shoe comprising a sole. The sole includes an upper sole member and a lower sole member of different materials. The lower sole member has a hole extending from its lower side to its upper side, and a projection of the upper sole member extends downwardly into the hole. The lower sole member further includes a longitudinal flex groove extending from a toe region to a front end of the hole, and from a rear end of the hole to a sole heel end. The longitudinal flex groove and hole combine to facilitate transverse flexion of the lower sole member in response to gait forces from the ground and a wearer's foot.

18 Claims, 8 Drawing Sheets

SHOE HAVING DUAL MATERIAL SOLE

CROSS-REFERENCE TO RELATED APPLICATIONS

Not applicable.

STATEMENT REGARDING FEDERALLY SPONSORED RESEARCH OR DEVELOPMENT

Not applicable.

APPENDIX

Not applicable.

BACKGROUND OF THE INVENTION

Field of the Invention

The present invention pertains to shoes having soles.

SUMMARY

One aspect of the disclosure is a shoe comprising a sole and an upper secured to the sole. The sole extends longitudinally from a sole heel end to a sole toe end and extends transversely from a sole lateral edge to a sole medial edge. The sole includes a heel region, a midfoot region, and a forefoot region. The heel region extends longitudinally from the sole heel end to the midfoot region. The midfoot region extends longitudinally from the heel region to the forefoot region. The forefoot region includes a ball region and a toe region. The ball region extends longitudinally from the midfoot region to the toe region. The toe region extends longitudinally from the ball region to the sole toe end. The sole has a lower sole member of a first material and an upper sole member of a second material different from the first material. The lower sole member extends from the sole heel end to the sole toe end and has a lower side and an upper side. A hole in the lower sole member extends from the lower side of the lower sole member to the upper side of the lower sole member. At least a portion of the hole is in the heel region. The lower side of the lower sole member defines a first groove segment extending from the forefoot region to the hole and a second groove segment extending from the hole to the sole heel end. A portion of the upper sole member extends downwardly from the upper side of the lower sole member into the hole in the lower sole member.

Further features and advantages of the disclosed subject matter, as well as its operation, are described in detail below with reference to the accompanying drawings.

DETAILED DESCRIPTION

Figure 1:
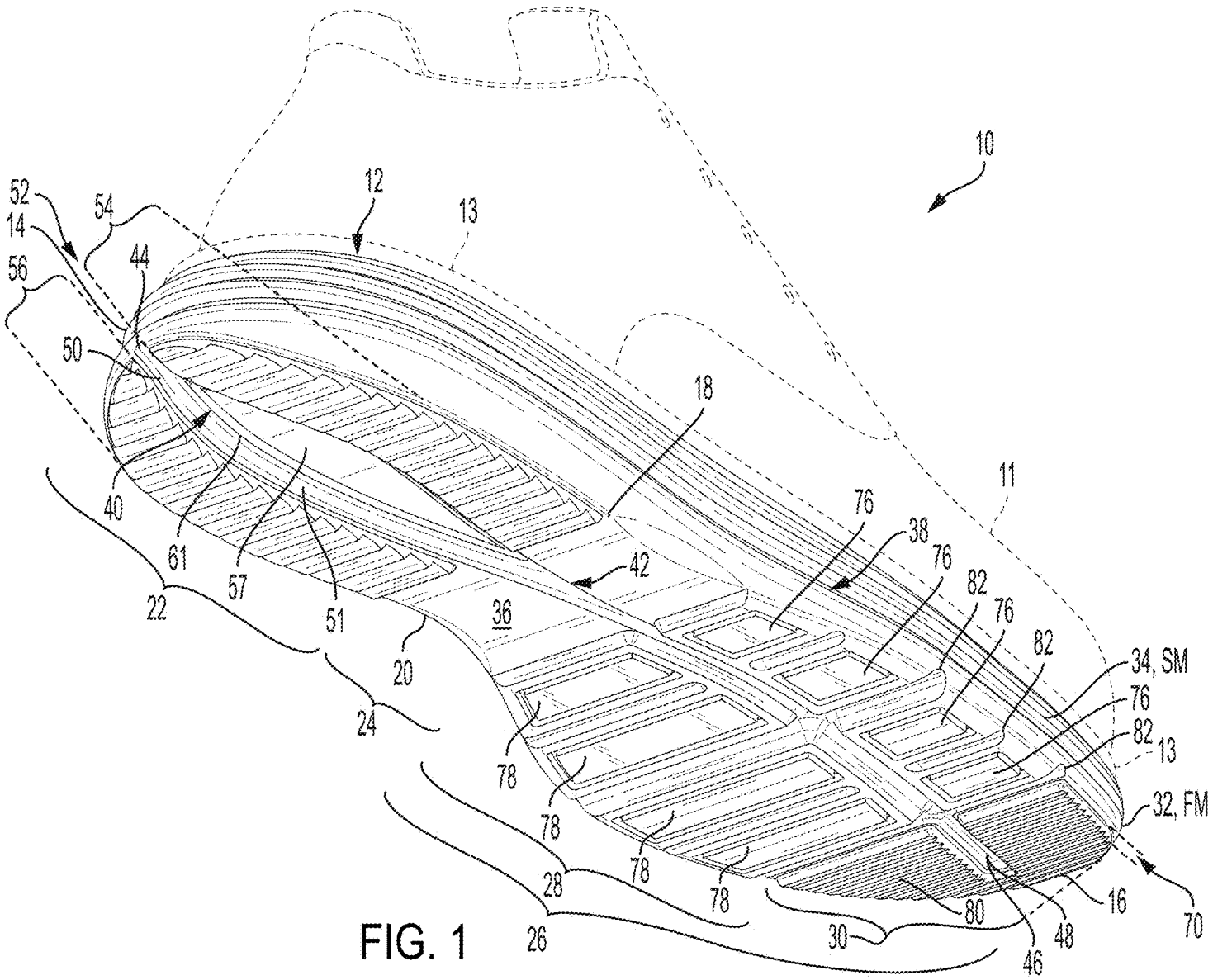
FIG. 1 is a bottom rear lateral perspective view of an exemplary embodiment of a shoe of the present disclosure.
Figure 2:
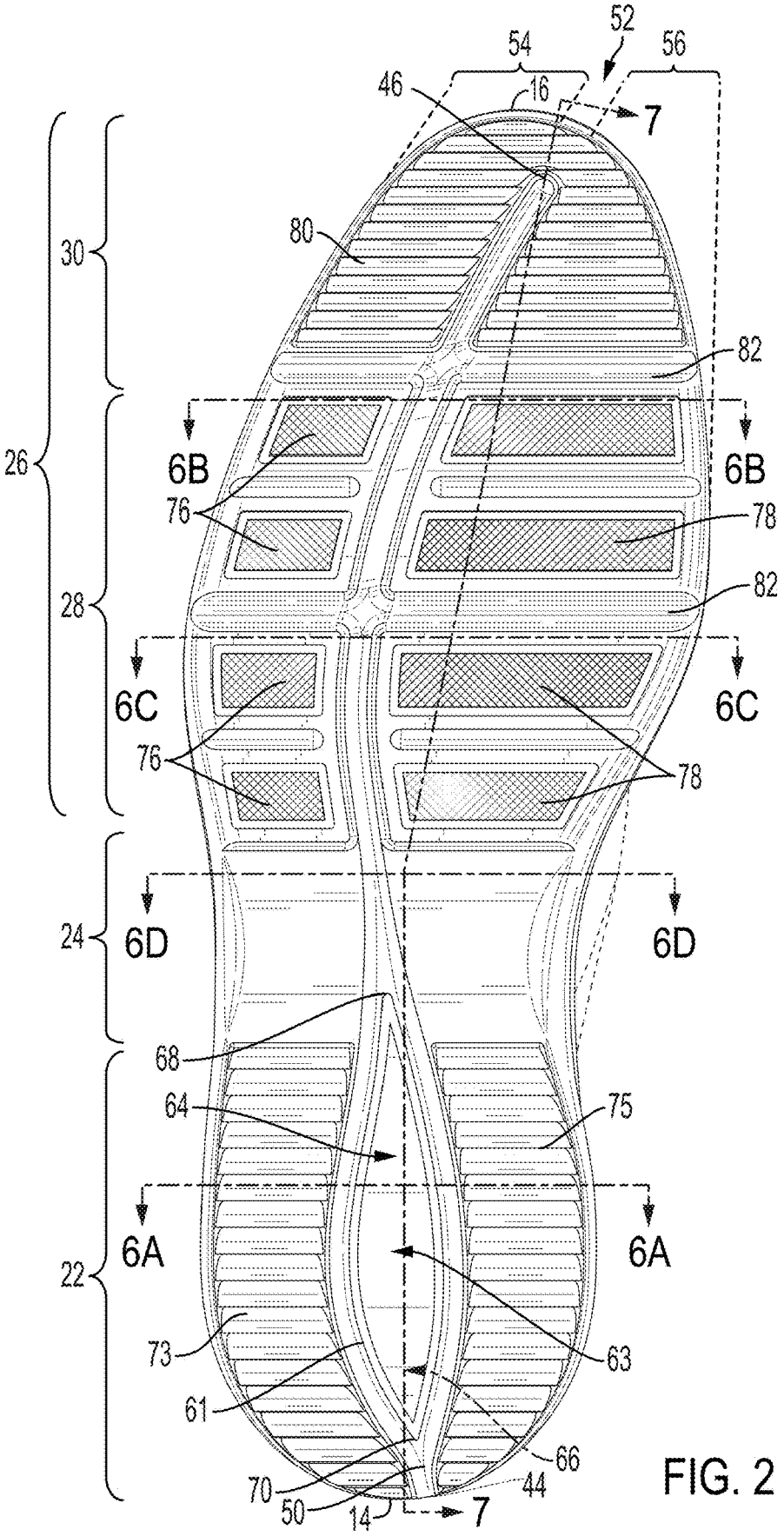
FIG. 2 is a bottom plan view of the shoe of FIG. 1
Figure 3:
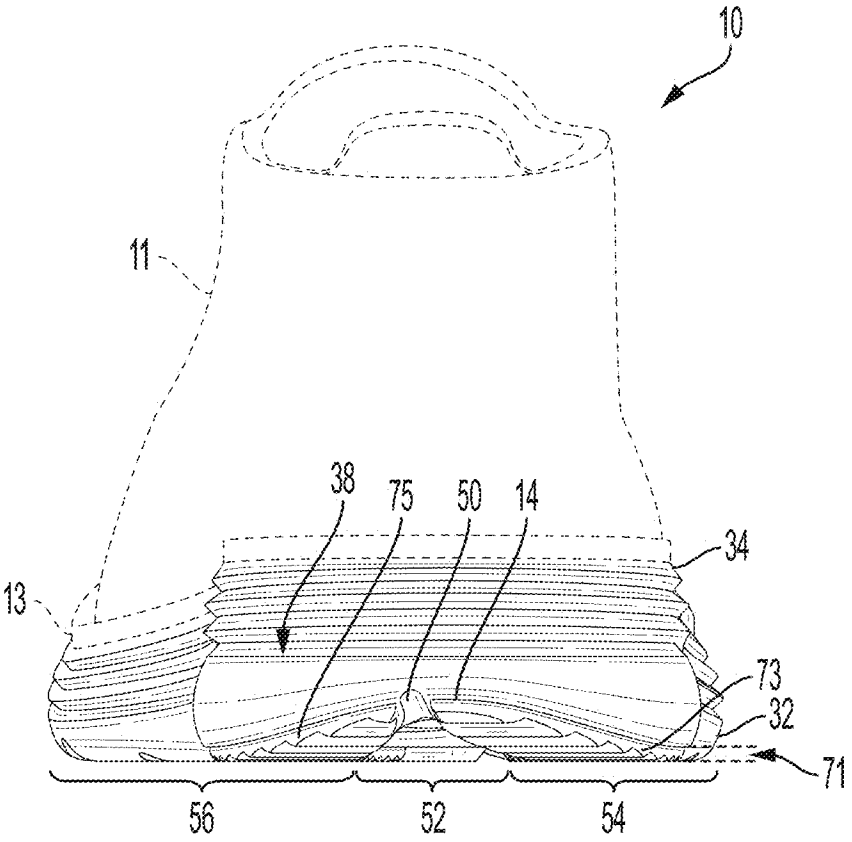
FIG. 3 is a rear view of the shoe of FIG. 1.
Figure 4:
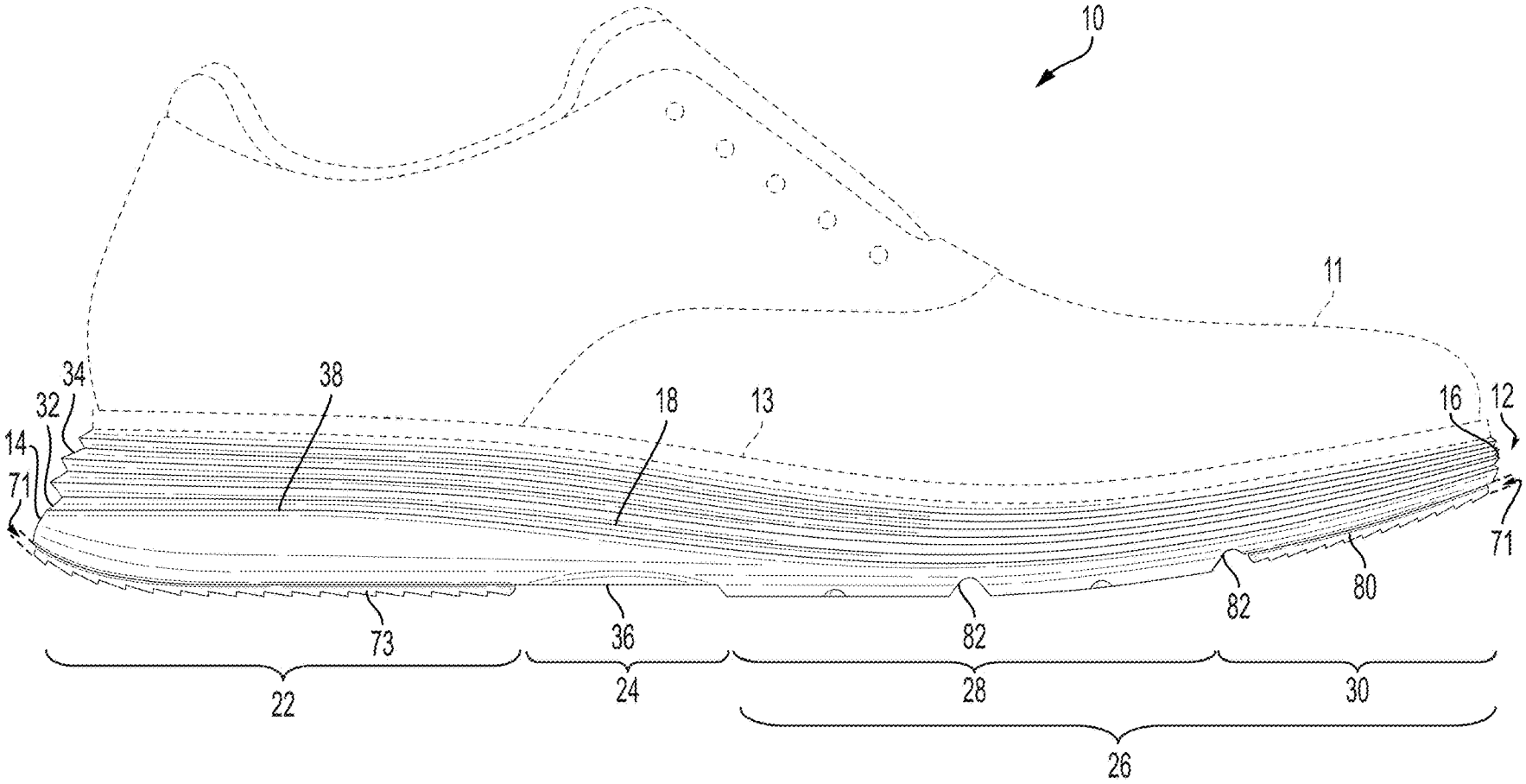
FIG. 4 is a lateral side view of the shoe of FIG. 1.
Figure 5:
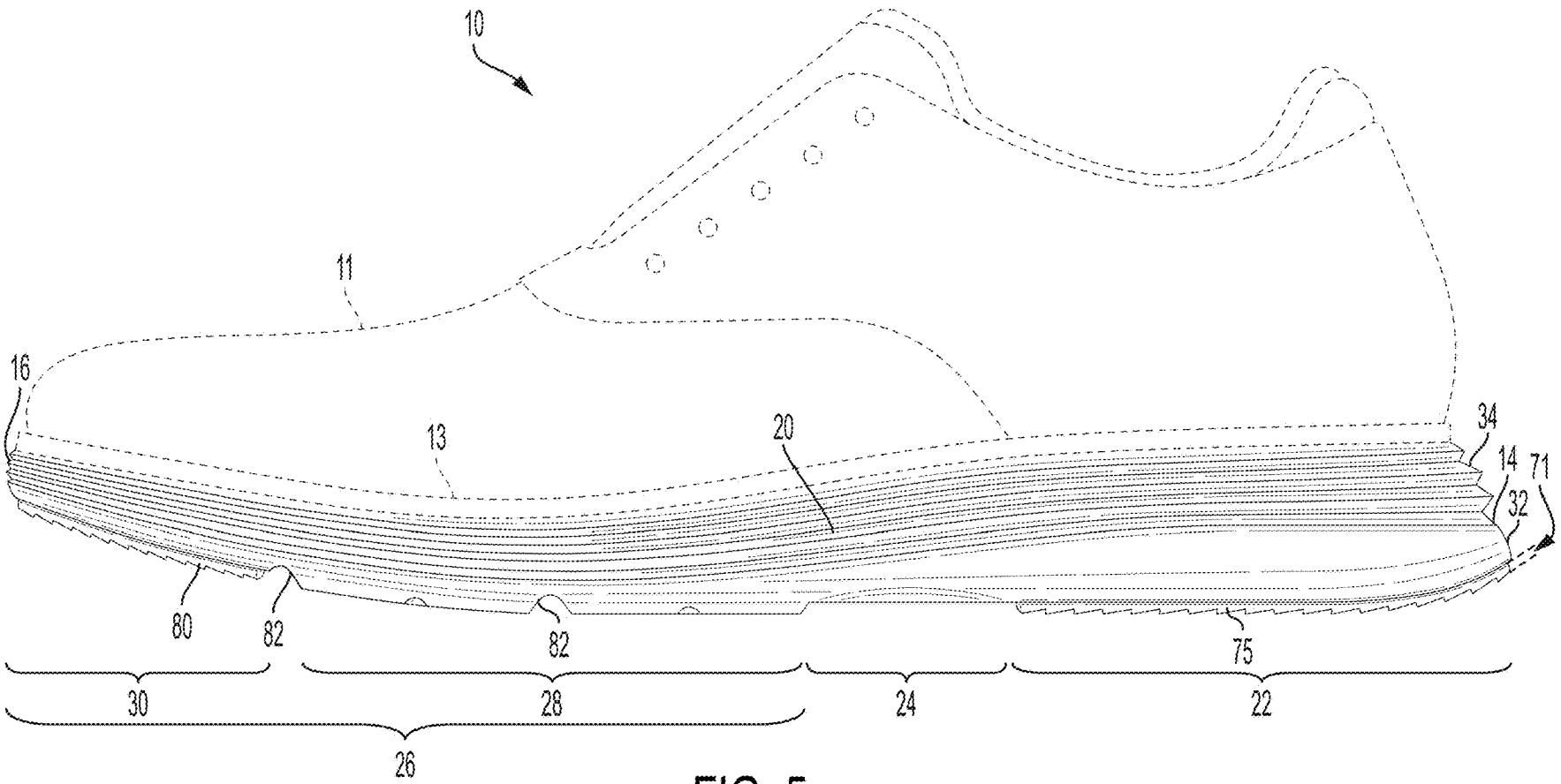
FIG. 5 is a medial side view of the shoe of FIG. 1.
Figure 6B:
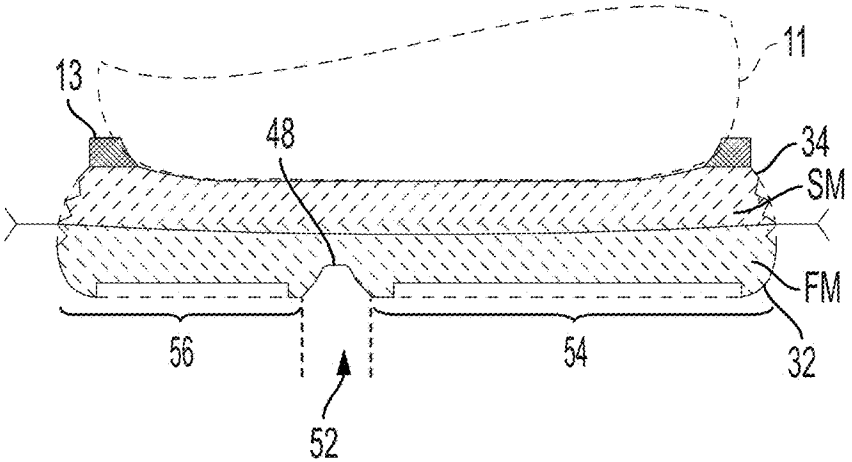
FIG. 6B is a front cross-sectional elevation view taken along line 6B-6B in FIG. 2.
Figure 6A:
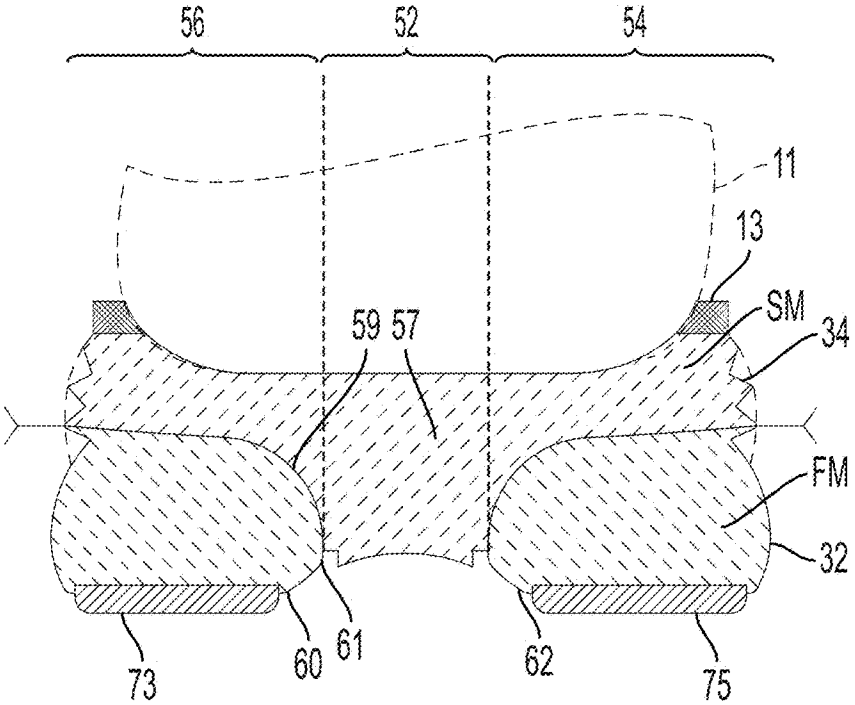
FIG. 6A is a front cross-sectional elevation view taken along line 6A-6A in FIG. 2.
Figure 6D:
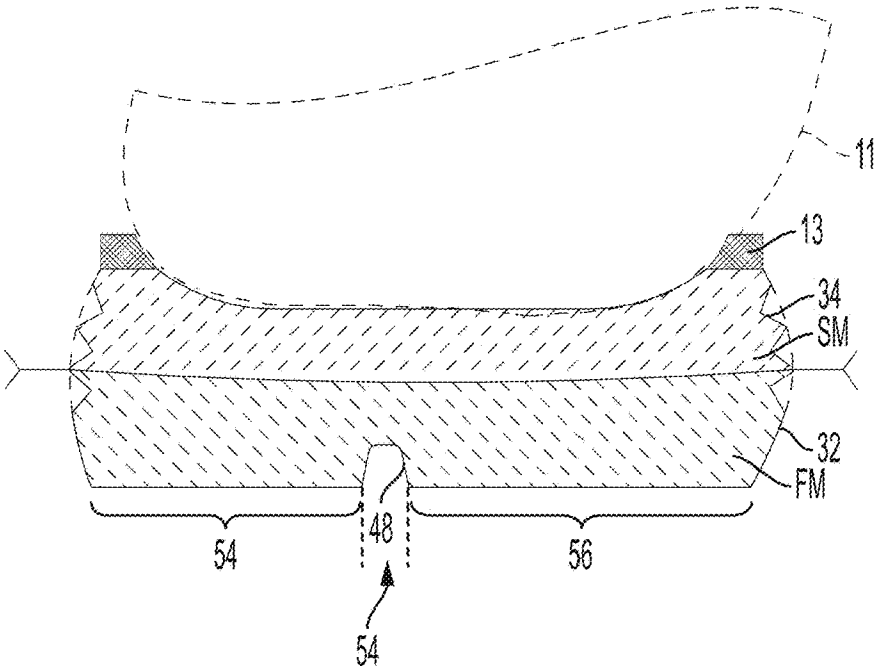
FIG. 6D is a front cross-sectional elevation view taken along line 6D-6D in FIG. 2.
Figure 6C:
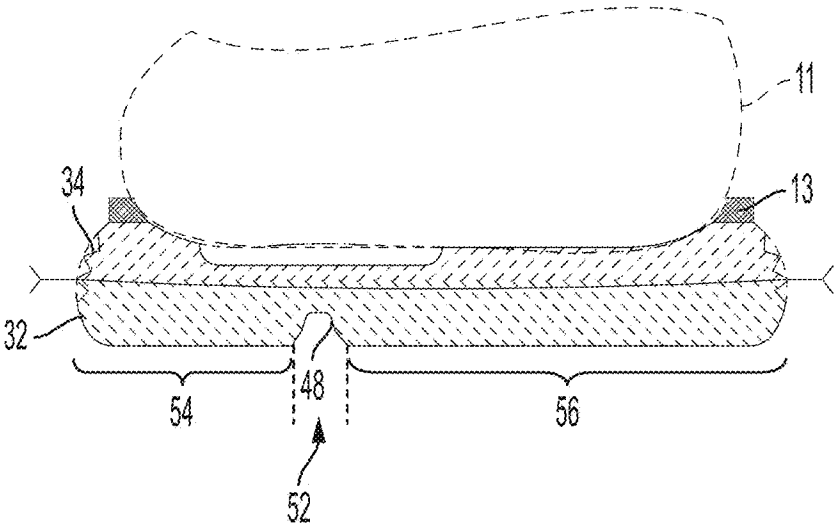
FIG. 6C is a front cross-sectional elevation view taken along line 6C-6C in FIG. 2.

An embodiment of a right shoe in accordance with the present invention is indicated by reference numeral 10 in FIGS. 1-5. It will be understood that shoe 10 may be worn with a left shoe (not shown) that is a mirror image of shoe 10.

Figure 7:
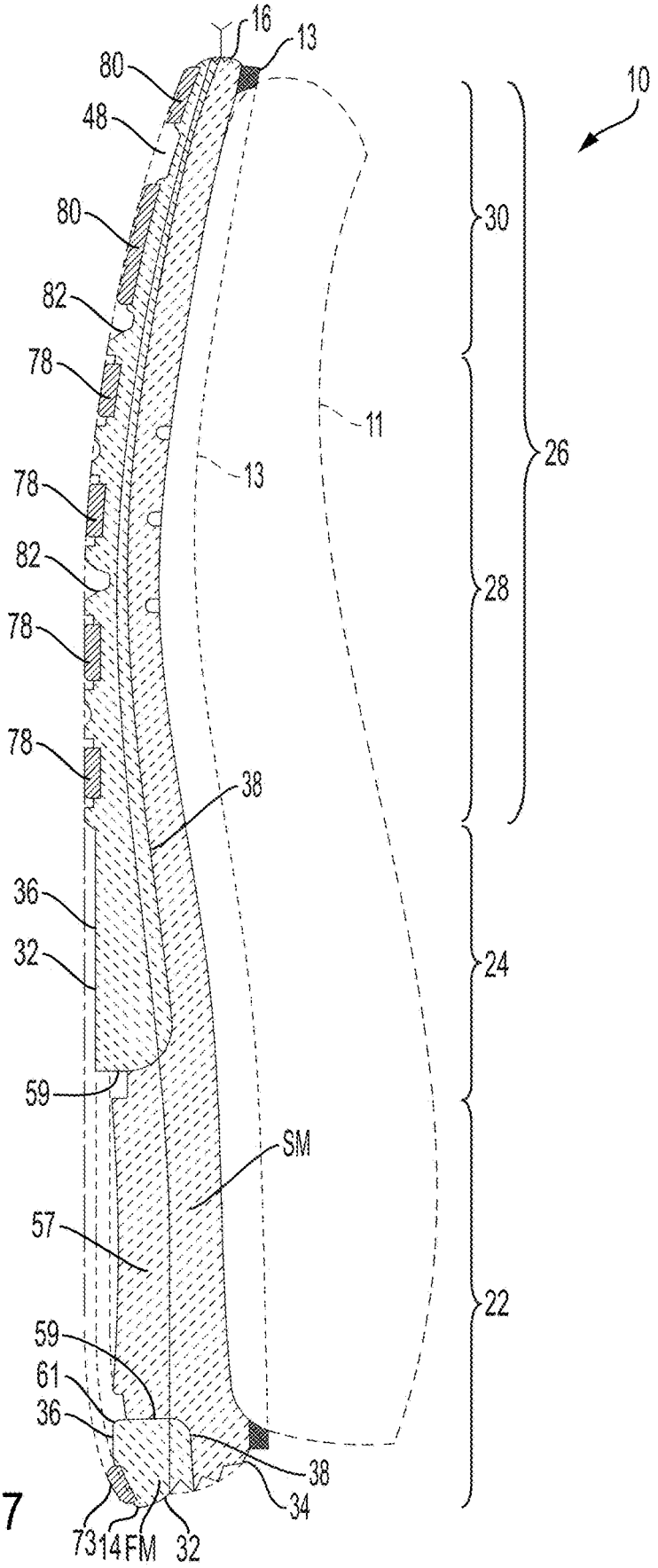
FIG. 7 is the union of two generally lateral cross-sectional elevation views taken along the two straight portions of the bent line 7-7 in FIG. 2.

Right shoe 10 includes an upper 11 secured to a sole 12, optionally by a welt 13, which may include stitching (not shown). Upper 11 and, except in cross-sectional drawing views, welt 13 are shown in phantom lines to facilitate illustration and identification of features of sole 12. Sole 12 extends longitudinally from a sole heel end 14 to a sole toe end 16 and transversely from a sole lateral edge 18 to a sole medial edge 20. To facilitate description of the size, position, shape, and orientation of certain features of shoe 10, sole 12 is divided into several regions generally arranged along its length, as shown and approximately designated in FIGS. 2, 4, 5, and 7. Sole 12 thus includes a heel region 22, a midfoot region 24, and a forefoot region 26, heel region 22 extending longitudinally from the sole heel end 14 to the midfoot region 24. Midfoot region 24, in turn, extends longitudinally from heel region 22 to the forefoot region 26. Forefoot region 26 includes a ball region 28 and a toe region 30, where ball region 28 extends longitudinally from midfoot region 24 to toe region 30, and toe region 30, in turn, extends longitudinally from ball region 28 to sole toe end 16.

Sole 12 comprises a lower sole member 32 of a first material FM and an upper sole member 34 of a second material SM different from first material FM. First material FM and second material SM have different properties, which may include visual properties, such as color, and/or mechanical properties, which may include, without limitation, one or more of durometer hardness, density, linear or non-linear stress-strain response in compression, tension, and bending, shape memory or elasticity, and rebound rate. In the illustrated embodiment, lower sole member 32 extends continuously from sole heel end 14 to a sole toe end 16. In other embodiments, a lower sole member may comprise spaced apart segments. Lower sole member 32 has a lower side 36 and an upper side 38. A hole 40 extends through lower sole member 32 from lower side 36 to upper side 38, generally in heel region 22.

A longitudinal flex groove 42 extends from heel end 14 to toe region 30, along a generally longitudinal path that curves medially from a groove rear end 44 to a groove front end 46. In other embodiments, a flex groove may follow a different generally longitudinal path and/or have front and rear ends located elsewhere in the forefoot and heel regions, respectively, of a lower sole member than as depicted.

Flex groove 42 includes a first groove segment 48 extending from the forefoot region to hole 40, a second groove segment 50 extending from hole 40 to the sole heel end, and a third groove segment 51 surrounding hole 40 and connecting first groove segment 48 to second groove segment 50. Thus, first groove segment 48, second groove segment 50, third groove segment 51, and hole 40 collectively define a longitudinally oriented central region 52 of sole 12, a lateral region 54 of sole 12 extending from sole lateral edge 18 to central region 52, and a medial region 56 of sole 12 extending from sole medial edge 20 to central region 52.

Third groove segment 51 is divided into a lateral section 60 and a medial section 62, formed by continuations of respective lateral and medial sections of first groove segment 48 that split apart where first groove segment 48 meets hole 40, trace respective lateral and medial sides of a perimeter of hole 40 in a rearward direction, and rejoin to form second groove segment 50 at a rear end of hole 40. Viewed another way, third groove segment 51 may be understood as a widened region of flex groove 42 where its lateral and medial sidewalls, comprising lateral section 60 and medial section 62, respectively, diverge to define a wider groove channel, and where a portion of a floor or bed of flex groove 42 between lateral section 60 and medial section 62 has been removed to form hole 40. In other embodiments, a first groove segment may abruptly terminate at a hole in a lower sole member, and a second groove segment may extend along the lower sole member from a rear end of the hole to a sole heel end.

A projection 57 of upper sole member 34 extends downwardly from upper side 38 of lower sole member 32 into hole 40. Preferably, projection 57 is bonded to an inner sidewall 59 of lower sole member 32 around the perimeter of hole 40, permitting the entire vertical thickness of upper sole member 34, both in and above hole 40, to compress vertically without touching the ground or floor, thus providing cushioning to a wearer's heel. Second material SM of upper sole member 34 is a softer, more deformable, and/or lower density material than first material FM of lower sole member 32. Optionally, second material SM is of a different color than first material FM. In other embodiments, a second material may have similar mechanical properties to a first material.

Accordingly, flex groove 42 and hole 40, at least partially filled by second material SM of projection 57 taking the place of first material FM, combine to facilitate flexion of lower sole member 32 as a wearer's foot rolls from heel to ball in contact with a floor or ground surface, for example, during walking.

A bottom opening 61 where hole 40 meets lower side 36 of lower sole member 32 has a generally tapered profile that is transversely (mediolaterally) wider in a middle region 63 and narrower in a forward region 64 and a rearward region 66, narrowing to a point at a front end 68, where first groove segment 48 splits to form the halves of third groove segment 51, and also at a rear end 70, where the halves of third groove segment 51 merge into second groove segment 50. In other embodiments, a bottom opening formed in a lower sole member may have other shapes, such as a similarly tapered shape that terminates more abruptly at flat front and rear ends, rather than gradually narrowing to a point. It is generally believed that lower sole member 32 is more flexible in transverse bending, expansion, and contraction across wider regions of hole 40 than across narrower regions of hole 40.

Sole 12 further includes an outsole 71, which in turn comprises a plurality of spaced-apart outsole members, each outsole member being affixed to the lower side 36 of lower sole member 32. The outsole members include a lateral heel outsole member 73 disposed in lateral region 54 and generally in heel region 22, a medial heel outsole member 75 disposed in medial region 56 and generally in heel region 22, four lateral ball outsole members 76 disposed in lateral region 54 and generally in ball region 28, four medial ball outsole members 78 disposed in medial region 56 and generally in ball region 28, and a toe outsole member 80 disposed generally in toe region 30 and extending forwardly around groove front end 46 from lateral region 54 to medial region 56. Beneficially, wherever an outsole member or portion of an outsole member is disposed on one side of central region 52, a corresponding outsole member or portion is disposed on the opposite side of central region 52, the two outsole members or portions being operative to transmit upward ground forces to lower sole member 32, which cooperate with centrally located downward forces from a wearer's foot to flex lower sole member 32 transversely.

As a complement to the longitudinal flex groove 42 promoting flexion of lower sole member 32 in transverse planes, lower sole member 32 further includes transverse flex grooves 82 extending from sole lateral edge 18 to sole medial edge 20, intersecting longitudinal flex groove 42, to promote flexion of lower sole member 32 in longitudinal planes.

In view of the foregoing, it should be appreciated that the invention has several advantages over the prior art.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations.

What is claimed is:

1. A shoe comprising:

a sole;

an upper secured to the sole;

the sole extending longitudinally from a sole heel end to a sole toe end and extending transversely from a sole lateral edge to a sole medial edge;

the sole including a heel region, a midfoot region, and a forefoot region, the heel region extending longitudinally from the sole heel end to the midfoot region, the midfoot region extending longitudinally from the heel region to the forefoot region, the forefoot region including a ball region and a toe region, the ball region extending longitudinally from the midfoot region to the toe region, and the toe region extending longitudinally from the ball region to the sole toe end;

the sole having a single lower sole member of a first material and an upper sole member of a second material different from the first material;

the lower sole member extending from the sole heel end to the sole toe end and having a lower side and an upper side;

a hole in the lower sole member extending from the lower side of the lower sole member to the upper side of the lower sole member, at least a portion of the hole being in the heel region, the hole having a forward end and a rearward end, the forward end of the hole being adjacent the lower side of the lower sole member, the rearward end of the hole being adjacent the lower side of the lower sole member, the forward end of the hole tapering at an acute angle to a point and pointing toward the toe end of the shoe, the rearward end of the hole tapering at an acute angle to a point and pointing toward the heel end of the shoe;

the lower side of the lower sole member defining a first groove segment extending from the forefoot region to the hole and a second groove segment extending from the hole to the sole heel end; and a portion of the upper sole member extending downwardly from the upper side of the lower sole member into the hole in the lower sole member when the shoe is in an unloaded state.

2. A shoe according to claim 1, wherein the lower side of the lower sole member further defines a third groove segment surrounding the hole.

3. A shoe in accordance with claim 2, wherein the third groove segment comprises a front end that meets the first groove segment, a rear end that meets the second groove segment, and a middle region, the middle region being wider than the front end and the rear end.

4. A shoe in accordance with claim 2, wherein the third groove segment connects the first and second groove segments to form a continuous groove comprising the first, second, and third groove segments.

5. A shoe in accordance with claim 1, wherein the hole meets the lower side of the lower sole member at a bottom opening, the bottom opening including a middle region, a forward region that is narrower than the middle region and meets the first groove segment, and a rearward region that is narrower than the middle region and meets the second groove segment.

6. A shoe in accordance with claim 5, wherein a width of the bottom opening tapers continuously in a forward longitudinal direction from the middle region to a front end of the bottom opening comprised in the forward region and in a rearward longitudinal direction from the middle region to a rear end of the bottom opening comprised in the rearward region.

7. A shoe in accordance with claim 6, wherein a profile of the bottom opening tapers to a first point at the front end and a second point at the rear end.

8. A shoe in accordance with claim 1, the first material being of a first color and the second material being of a second color.

9. A shoe in accordance with claim 1, the first material being of a first density and the second material being of a second density.

10. A shoe in accordance with claim 1, the first material being of a first durometer hardness and the second material being of a second durometer hardness.

11. A shoe in accordance with claim 1, the upper sole member extending at least from the heel region to the ball region.

12. A shoe in accordance with claim 1, the upper sole member extending from the sole heel end to the sole toe end.

13. A shoe in accordance with claim 1, the upper and lower sole members extending transversely from the sole lateral edge to the sole medial edge.

14. A shoe in accordance with claim 1, the lower sole member further including at least one transverse flex groove extending transversely from the sole lateral edge to the sole medial edge, the transverse flex groove intersecting the first groove segment.

15. A shoe in accordance with claim 1, the first groove segment, hole, and second groove segment collectively defining a central region of the sole, the sole having a lateral region and a medial region, the sole lateral region extending from the sole lateral edge to the sole central region, and the sole medial region extending from the sole medial edge to the central region, the sole further including an outsole operatively connected to the lower side of the lower sole member, the outsole comprising a medial heel outsole member, disposed in the medial region and at least partially in the heel region, and a lateral heel outsole member, disposed in the lateral region and at least partially in the heel region.

16. A shoe in accordance with claim 15, the hole extending forward beyond the medial heel outsole member and the lateral heel outsole member.

17. A shoe in accordance with claim 1, the first groove segment, hole, and second groove segment collectively defining a central region of the sole, the sole having a lateral region and a medial region, the sole lateral region extending from the sole lateral edge to the sole central region, and the sole medial region extending from the sole medial edge to the central region, the sole further including an outsole operatively connected to the lower side of the lower sole member, the outsole comprising a toe outsole member generally disposed in the toe region, a medial portion of the toe outsole member disposed in the medial region, a lateral portion of the toe outsole member disposed in the lateral region, and a central portion of the toe outsole member disposed in the central region in front of a front end of the first groove segment.

18. A shoe in accordance with claim 1, the first groove segment, hole, and second groove segment collectively defining a central region of the sole, the sole having a lateral region and a medial region, the sole lateral region extending from the sole lateral edge to the sole central region, and the sole medial region extending from the sole medial edge to the central region, the sole further including an outsole operatively connected to the lower side of the lower sole member, the outsole comprising a plurality of medial outsole members disposed in the medial region between the toe region and the heel region and a plurality of lateral outsole members disposed in the lateral region between the toe region and the heel region.

* * * * *